US009963908B2

(12) United States Patent
Bass et al.

(10) Patent No.: US 9,963,908 B2
(45) **Date of Patent: *May 8, 2018**

(54) DATA KEY AND METHOD OF USING SAME

(75) Inventors: Michael A. Bass, Chagrin Falls, OH (US); Sandra Dively, Sagamore Hills, OH (US); Robert Steinberg, Shaker Heights, OH (US); Richard W. Ryai, Sr., North Royalton, OH (US)

(73) Assignee: HY-KO PRODUCTS COMPANY, Northfield, OH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 13/222,005

(22) Filed: Aug. 31, 2011

(65) Prior Publication Data

US 2012/0038453 A1 Feb. 16, 2012

Related U.S. Application Data

(63) Continuation-in-part of application No. 12/965,319, filed on Dec. 10, 2010, now Pat. No. 8,074,481, (Continued)

(51) Int. Cl.
*G07C 9/00* (2006.01)
*E05B 19/00* (2006.01)
(Continued)

(52) U.S. Cl.
CPC ..... *E05B 19/00* (2013.01); *G07C 9/00944* (2013.01); *E05B 17/0004* (2013.01);
(Continued)

(58) Field of Classification Search
CPC ..... G07C 9/00309; G07C 9/00182
(Continued)

(56) References Cited

U.S. PATENT DOCUMENTS 3,841,120 A 10/1974 Gartner
3,958,105 A 5/1976 Sidlauskas
(Continued)

FOREIGN PATENT DOCUMENTS

DE 29917257 5/2000
DE 19723039 12/2003
(Continued)

OTHER PUBLICATIONS

One page printout from www.theaa.com/allaboutcars/security/keys.html, dated Jul. 8, 2004.
(Continued)

*Primary Examiner* — Vernal Brown
(74) *Attorney, Agent, or Firm* — McDonald Hopkins LLC

(57) ABSTRACT

Some of the inventive concepts described herein include a data key having a computer readable medium containing information indicative of a bitting pattern for a master key. The bitting pattern on the data key may be downloadable to a key cutting device to cut a duplicate key that has the same bitting pattern as the master key. In addition, a method of creating a data key is also provided herein. The method includes identifying a type of key; identifying a bitting pattern; and storing the type of key blank required and bitting pattern to be cut in the key blank on a computer readable medium.

17 Claims, 4 Drawing Sheets

Related U.S. Application Data which is a continuation of application No. 11/224,194, filed on Sep. 12, 2005, now Pat. No. 7,849,721.

(60) Provisional application No. 60/609,188, filed on Sep. 10, 2004.

(51) Int. Cl.
*E05B 19/24* (2006.01)
*E05B 17/00* (2006.01)

(52) U.S. Cl.
CPC ..... *E05B 19/24* (2013.01); *G07C 9/00896* (2013.01); *G07C 2009/00793* (2013.01); *G07C 2209/62* (2013.01)

(58) Field of Classification Search
USPC ..... 340/5.6, 542
See application file for complete search history.

(56) References Cited

U.S. PATENT DOCUMENTS 4,200,227 A 4/1980 Lemelson
4,673,932 A 6/1987 Ekchian
4,688,036 A 8/1987 Hirano et al.
4,738,334 A 4/1988 Weishaupt
4,939,917 A 7/1990 Cartwright
5,232,528 A 8/1993 Reznickenko et al.
5,351,409 A 10/1994 Heredia
5,365,235 A 11/1994 Kennedy et al.
5,477,214 A 12/1995 Bartel
5,561,331 A 10/1996 Suyama et al.
5,807,042 A 9/1998 Almblad et al.
5,836,187 A 11/1998 Janssen et al.
5,842,365 A 12/1998 Bordonaro
5,874,896 A 2/1999 Lowe et al.
5,905,446 A * 5/1999 Benore et al. ..... 340/5.7
5,908,273 A 6/1999 Titus et al.
5,952,937 A 9/1999 Koopman et al.
6,064,747 A 5/2000 Wills et al.
6,204,764 B1 3/2001 Maloney
6,216,501 B1 4/2001 Marquardt et al.
6,276,179 B1 8/2001 Janssen et al.
6,297,725 B1 10/2001 Tischendorf et al.
6,367,299 B1 4/2002 Janssen et al.
6,386,007 B1 5/2002 Johnson et al.
6,406,227 B1 * 6/2002 Titus et al. ..... 409/81
6,407,665 B2 6/2002 Maloney
6,427,504 B1 8/2002 Janssen et al.
6,427,913 B1 8/2002 Maloney
6,457,337 B1 10/2002 Hattick et al.
6,460,386 B1 10/2002 Watanuki et al.
6,600,418 B2 7/2003 Francis et al.
6,637,245 B1 10/2003 Bolton
6,647,308 B1 * 11/2003 Prejean ..... 700/117
6,647,752 B1 11/2003 Chaillie
6,672,118 B1 1/2004 Wright
6,681,990 B2 1/2004 Vogler et al.
6,687,565 B2 * 2/2004 Wetterlin et al. ..... 700/161
6,710,701 B2 3/2004 Leatherman
6,765,311 B1 7/2004 Labonde
6,801,829 B2 * 10/2004 Kawai ..... 700/161
6,933,849 B2 8/2005 Sawyer
6,948,344 B2 9/2005 Janssen
6,952,156 B2 10/2005 Arshad et al.
6,978,118 B2 * 12/2005 Vesikivi et al. ..... 455/41.1
6,998,956 B2 2/2006 Dix
7,098,791 B2 8/2006 Okada
7,142,413 B2 11/2006 Sugimoto et al.
7,236,085 B1 6/2007 Aronson et al.
7,290,419 B2 11/2007 Balko et al.
7,310,980 B2 12/2007 Hashimoto et al.
7,360,383 B1 4/2008 Chang
7,370,501 B2 5/2008 Miyata et al.
8,074,481 B2 * 12/2011 Bass et al. ..... 70/408
2001/0034565 A1 10/2001 Leatherman
2002/0038267 A1 3/2002 Can et al.
2002/0084887 A1 7/2002 Arshad et al.
2002/0126010 A1 * 9/2002 Trimble et al. ..... 340/568.1
2002/0158751 A1 10/2002 Bormaster
2003/0051520 A1 3/2003 Janssen et al.
2003/0144926 A1 7/2003 Bodin et al.
2003/0189482 A1 10/2003 Arshad et al.
2003/0200778 A1 10/2003 Chhatwal
2003/0210128 A1 11/2003 Dix
2003/0216969 A1 11/2003 Bauer et al.
2004/0024730 A1 2/2004 Brown et al.
2004/0069850 A1 4/2004 De Wilde
2004/0095380 A1 5/2004 Bass et al.
2004/0143505 A1 7/2004 Kovach
2004/0189440 A1 * 9/2004 Wong ..... B60R 25/00 340/5.7
2004/0237613 A1 12/2004 Shimura
2004/0252030 A1 12/2004 Trimble et al.
2004/0263316 A1 12/2004 Dix et al.
2005/0088279 A1 4/2005 Denison et al.
2005/0166650 A1 8/2005 Shimura et al.
2005/0223766 A1 10/2005 Hashimoto et al.
2006/0053848 A1 3/2006 Ghabra et al.
2006/0150696 A1 7/2006 Eychenne et al.
2006/0159260 A1 7/2006 Pereira et al.
2006/0202798 A1 9/2006 Baumgartner et al.
2006/0230796 A1 10/2006 Keller et al.
2006/0260370 A1 11/2006 Miwa et al.
2006/0261925 A1 11/2006 Baumgartner et al.
2006/0266089 A1 11/2006 Dimig
2007/0003388 A1 1/2007 Doong
2007/0033974 A1 2/2007 Calavenna
2007/0056338 A1 3/2007 Sabo et al.
2007/0103271 A1 5/2007 King et al.
2007/0262640 A1 11/2007 Szczerba et al.
2008/0127693 A1 6/2008 Cadiz et al.
2008/0129448 A1 6/2008 Reichling

FOREIGN PATENT DOCUMENTS

EP 0291614 11/1988
EP 1035503 9/2000
EP 1221518 7/2002
EP 1923823 A2 5/2008
GB 2435323 A 8/2007
JP 2003150733 5/2003

OTHER PUBLICATIONS

Partial International Search Report from PCT/US2005/032584.
PCT International Search Report and Written Opinion, dated Dec. 7, 2012, from related Application No. PCT/US2012/050678.

* cited by examiner

DATA KEY AND METHOD OF USING SAME

CROSS REFERENCE TO RELATED APPLICATIONS

This application is a continuation in part of and claims the benefits of and priority to U.S. patent application Ser. No. 12/965,319 titled "Radio Frequency Identification (RFID) System for Manufacturing, Distribution and Retailing of Keys" filed on Dec. 10, 2010; which is a continuation of U.S. patent application Ser. No. 11/224,194, now U.S. Pat. No. 7,849,721, also titled "Radio Frequency Identification (RFID) System for Manufacturing Distribution and Retailing of Keys" which was filed in the United States Patent Office on Sep. 12, 2005; which claims priority to and the benefits of U.S. Provisional Application Ser. No. 60/609,188, also titled "Radio Frequency Identification (RFID) System for Manufacturing Distribution and Retailing of Keys" filed on Sep. 10, 2004. These applications are incorporated by reference herein in their entirety.

TECHNICAL FIELD

This invention relates to a data key for creating duplicates of keys and a method of using the same.

BACKGROUND

People often lose their keys. Losing a key is aggravating and can be very expensive. Often a person must call a locksmith to change the locks on their home or to open a vehicle. Further, most vehicle keys today have microchips implanted in them and a person often is required to order a new key from the dealership and wait until that key is shipped to them. In the event the person previously lost their spare key, or are out of town, they may be without their vehicle for days.

FIG. 1 illustrates a prior art standard key blank 100. Key blank 100 includes a bow 110 having a hole 105 there through and a blade 115. Key blank 100 also includes a groove 120. In addition, some key blanks 100 include a microchip 140. Microchip 140 may be programmed, for example, to communicate with a specific vehicle. FIG. 2 illustrates a standard prior art "cut" key 200, or a "master" key. Master key as used herein refers to a key that is to be copied irrespective of whether that key may be used to open a single lock or a number of locks. For example, if a person brings in their house key to be copied, this key may be referred to as a master key. Key 200 includes a bow 210 having a hole 205 there through and a blade 215. Key 200 includes a groove 220. In addition, key 200 includes a plurality of teeth 225 and notches 230. The teeth 225 and notches 230 are referred to as "bittings" or bitting patterns. Bittings typically have different depths, widths, spacing and frequencies. Key 200 may also include microchip 240. In such instances, microchip 240 is typically programmed to communicate with a specific vehicle to enable key 200 to start that vehicle.

SUMMARY

Some of the inventive concepts described herein include a data key having a computer readable medium containing information indicative of a bitting pattern for a master key. The bitting pattern on the data key may be downloadable to a key cutting device to cut a duplicate key that has the same bitting pattern as the master key. In addition, a method of creating a data key is also provided herein. The method includes identifying a type of key; identifying a bitting pattern; and storing the type of key blank required and bitting pattern to be cut in the key blank on a computer readable medium.

Other features and advantages of the invention will be apparent from the description and drawings, and from the claims.

DETAILED DESCRIPTION

Figure 3:
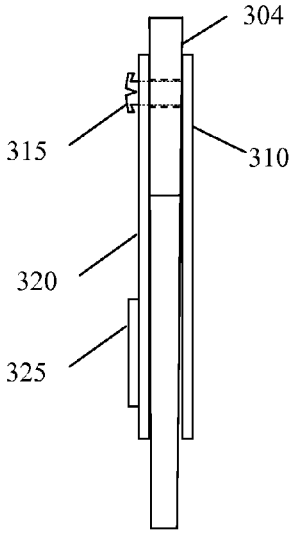
FIG. 3 is a side view of a data source and a cover plate secured to a key blank in accordance with one embodiment of the present invention.

FIG. 3 is a side view of a key blank 304, a data source 320 and a cover plate 310. Cover plates described herein may be any suitable material, such as for example cardboard or plastic. Cover plates may be rigid or flexible. In one embodiment, cover plate 310 includes a projection 315 that fits through the hole 105 of key blank 100. Projection 315 is configured to slide through the hole 105 of key blank 100 and through a hole in data source 320. Cover plate 310 may include consumer readable information such as, for example, advertising information, manufacturer name, trademarks, part numbers, pricing and skew numbers.

Data source 320 is a media capable of conveying data. Data source 320 may contain human readable information. Data source 320 may any suitable material, such as, for example, cardboard or plastic. Data source 320 may be attached directly to the key blank, attached to a package surrounding the key blank or connected to a cover plate 310 as shown in FIG. 3. Data source 320 may be a card with written instructions. Those written instructions may include, for example, how to select the proper key blank and positioned it in the key cutting machine when making a copy of the key.

In one embodiment, data source 320 includes coded instructions that are machine-readable. These instructions may be read by a computer and displayed for a user/sales person to follow. These instructions may include, for example, instructions on how to position the key and key blanks in the cutting machine, instructions to obtain the customer's identification information, instructions on the proper forms to fill out, instructions to offer the customer promotional deals or discounts on additional keys or other related items, such as, key chains, and bow covers. In such cases, data source 320 includes an electronic information storage device 325, such as, for example, a radio frequency identification device ("RFID") or a microchip. The electronic information storage device 325 includes a computer readable medium, such as, for example, random access memory ("RAM"), read only memory ("ROM"), flash memory or any other memory capable of storing data. Accordingly, data source 320 includes memory on which electronic data may be stored and/or retrieved.

The term "data key" as used herein refers to information related to duplicating a key that is electronically stored on a computer readable medium, or the electronic information storage device. In one embodiment, a data key is an electronic information storage device 325 that is programmed to contain one or more of: directions, release forms, customer identification information, customer validation information, or key characteristics, such as for example, the type of key, the type of key blank, an origination address, a destination address, a manufacturer, a manufacturing date, a lot number, etc. The information may be read through a reader, such as an RFID reader, or may be read and displayed on a display viewable by a user, such as a point of sales person. In one embodiment, the electronic information device 325 plugs into a port on a computer allowing the information to be displayed or downloaded to the computer. The electronic information storage device 325 may be secured to data source 320, may be embedded completely within, or partially within, data source 320. In one embodiment, data source 320 includes both human readable information and electronically stored data.

Information may be stored on the electronic information storage device 325 at any point in the distribution channel, such as, for example, at the time the customer desires to have a key copied, or have an electronic or digitized copy of the key made. Such information may include, for example, information related to the customer or information related to the key bitting that is, or will be, cut into the key blank. Additional information may also include, for example, data indicative of information that is stored on the original key that is being copied. In one embodiment, a key being copied is a key for a vehicle (not shown) that has a microchip embedded within the key. The microchip (not shown) contains electronic data that a duplicated, or copied key, must also have for the duplicated key to be able to start the car. Accordingly, this type of information may be stored on the electronic information storage device 325. The data source 320 and electronic information storage device 325 may be retained by the customer, and a duplicate key can be created at any time by inputting the stored information into a key duplicating machine.

Figure 4:
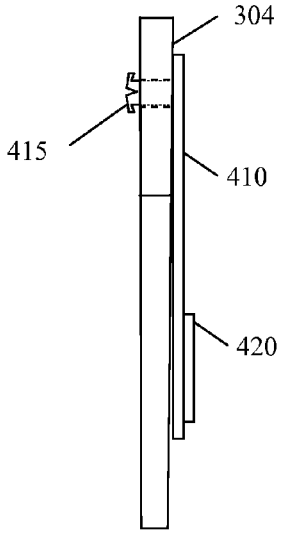
FIG. 4 is a side view of a data source/cover plate secured to a key blank in accordance with another embodiment of the present invention.

FIG. 4 illustrates another embodiment of the present invention, which includes a cover plate 410 having a projection 415. Projection 415 is a snap fit connector that is pressed through a hole in key blank 304 and secures cover plate 410 to the key blank 304. Cover plate 410 contains indicia of the manufacturer and an electronic information storage device 420 which may be secured to cover plate 410 by for example, an adhesive. In one embodiment, electronic information storage device 420 is embedded within, or at least partially within, cover plate 410. Electronic information storage device 420 may include information such as the information described with reference to FIG. 3, and may be returned by the customer.

Figure 1:
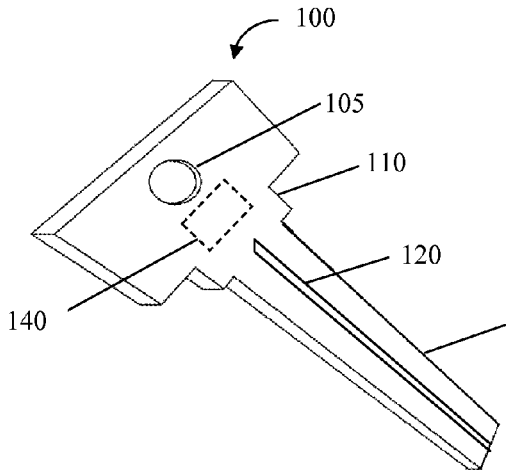
Fig. 1 (Prior Art)
FIG. 1 is a prospective view of a standard prior art key blank.
Figure 2:
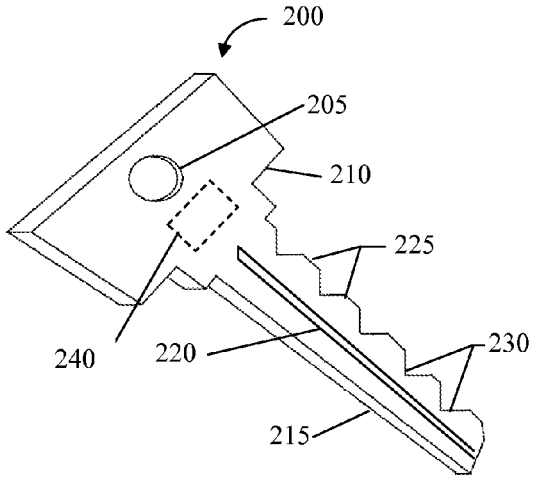
Fig. 2 (Prior Art)
FIG. 2 is a prospective view of a standard prior art key.
Figure 5:
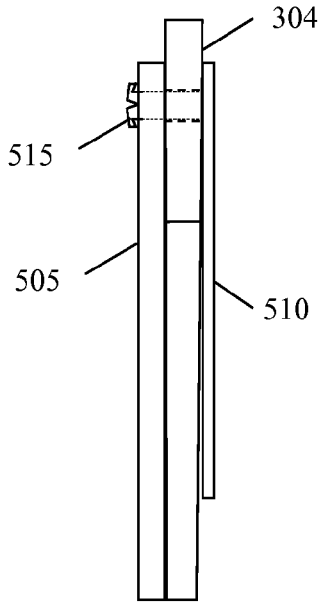
FIG. 5 is a side view a data source and a cover plate secured to a key blank in accordance with an embodiment of the present invention.

FIG. 5 illustrates yet another embodiment of a cover plate 510 and a data source 505 secured to a key blank 304. Data source 505 may be made of any material that holds its shape, such as vinyl or other suitable plastic material. Securing means 515 secures cover plate 510 and data source 505 to key blank 304. In this embodiment, cover plate 510 includes human readable information and data source 505 includes grooves (not shown) similar to the grooves in key blank 100 (FIG. 1) and master key 200 (FIG. 2). Data source 505 and the customer's key may be inserted into a key cutting machine and a bitting pattern that corresponds to the bitting pattern in the original key or master key may be cut into data source 505. The customer may retain data source 505 and if the customer loses her key, she need only to bring in data source 505 to a retailer and have a new key created based on the information cut into data source 505.

In one embodiment, data source 505 also includes an electronic information storage device (not shown). As described above, information, such as key cutting machine setup information, the bitting pattern, the proper type of key blank, and customer identification may be stored on the electronic storage device (not shown). In addition, the electronic storage device (not shown) may include additional information that is required for a complete copy of a key to be made. Such information includes, for example, codes necessary for a key to operate a specific locking mechanism. This information may be retrieved and utilized to create a duplicate key. In one embodiment, data source 505, or any of the other data sources described herein, has substantially the same dimensions as a credit card. Accordingly, the data source fits conveniently in a user's wallet or purse. Thus, data source 505 enables a customer to go to an establishment that has s manual key cutting machine and use data source 505 as a master key (provided that electronic data is not required for the key to operate the locking mechanism) or go to an establishment that has a key cutting machine that can retrieve the electronic information stored on the electronic storage device and cut a new key based on that information.

Figure 6:
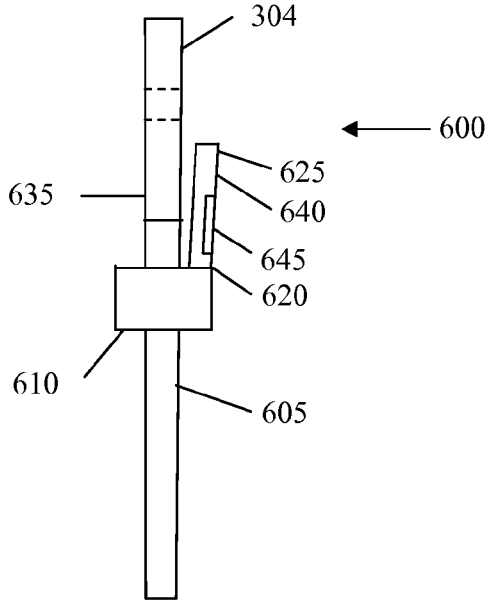
FIG. 6 is a side view of yet another embodiment of a data source and a cover plate secured to a key blank.

FIG. 6 illustrates yet another embodiment of a data key 600 secured to a key blank 304. This embodiment includes a sleeve 610 sized to fit over the blade of a key blank 304. Optionally sleeve 610 includes one or more protrusions that fit within a groove (not shown) on the blade of the key blank 304. In one embodiment, releasable secured to the sleeve 610 is cover plate 625. Cover plate 625 may include human readable indicia. These human readable indicia may include, for example, steps for cutting the key, connecting an adaptor to a key, indicia of the manufacturer, model number, and type of key blank. In addition, in one embodiment, cover plate 625 also includes data source 640. Data source 640 is similar to the data sources described above and may also contain an electronic information storage device 645. Cover plate 625, data source 640 and electronic information storage device 645 are connected to sleeve 610 in an area of reduced cross section 620. The reduced cross section 620 allows a user to bend cover plate 625 and break it off from sleeve 610.

Figure 7:
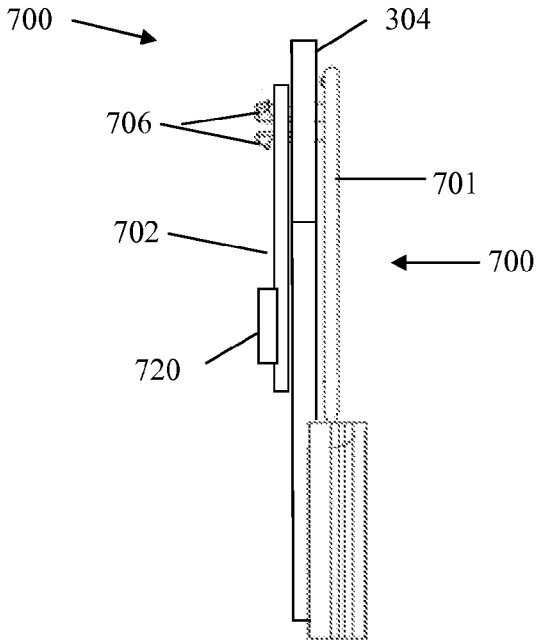
FIG. 7 is a side view of yet another exemplary embodiment of a data source and a cover plate secured to a key blank.

FIG. 7 is a side view of embodiment of a wishbone adaptor 701 and data source 702. Wishbone adaptor 701 is fully described in provisional application Ser. No. 61/364, 228 entitled "Method and Apparatus For Holding Keys During The Cutting Process" and is incorporated herein in its entirety by reference. Data source 702 and electronic information storage device 720 are similar to data source 320 and electronic information storage device 325 described in detail with respect to FIG. 3. Wishbone adaptor 500 is connected to data source 702 through the hole of a key blank 704.

Figure 8:
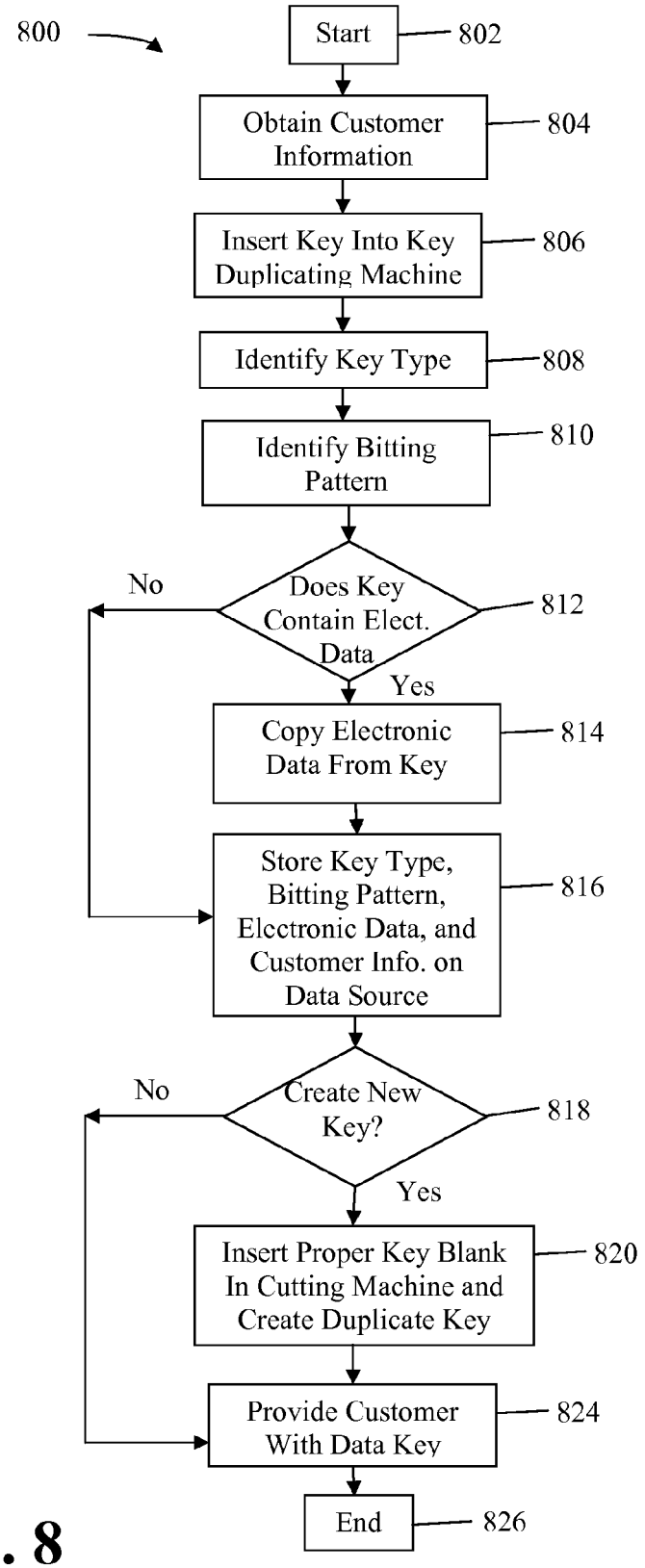
FIG. 8 is an exemplary block diagram of a method for creating a duplicate key and a data key.

FIG. 8 illustrates a method of creating a data key and a method of duplicating a key. The method begins at block 802. Customer information is obtained at block 804. This information may include, for example, the customers' name, an authentication code, a pin number, etc. The customer's key is inserted into the key duplicating machine at block 806 and the type of key is identified at block 808. The bitting pattern is determined at block 810 and a determination is made at block 812 as to whether the customer's key contains electronic data. If it does not, the method proceeds to block 816. If the customer's key contains electronic data, the electronic data is copied from the key at block 814. At block 816, the key type, bitting pattern, electronic data if available and optionally the customer information are stored on an electronic information storage device, or data key. A determination is made as to whether the customer wants the key duplicated at block 818. If the customer wants the key duplicated, the proper key blank is inserted into the key cutting machine and a duplicate key is made at block 820. At block 824, the customer is provided with the data key and ends at block 826.

In one embodiment, a customer can have a data key made without making a physical copy of the key. Accordingly, for keys that are expensive to duplicate because the key blanks are expensive, such as for example, automobile keys, a user may simply have a data key created and kept in a safe place for use in an emergency or in the event the customer loses her automobile key. Because the data key contains all of the information required to duplicate the customer's key, a duplicate key may be created without having the original key.

The "information" described above with respect to a specific data source, electronic information storage device, or data key is also applicable to the other embodiments described herein even though that information may not have been specifically described with respect to a particular embodiment. Accordingly, such information is included in whole, in part or in any combination thereof in each embodiment. In addition, additional information, such as, for example, automobile warranty information or dealer maintenance records that would be convenient for the customer to have on hand may also be stored on an electronic data source.

Security information may also be stored on the data source or data key. Security information may include a customers' name, a personal identification number ("PIN"), or biometric data, such as a fingerprint scan, photographic data, retinal scan and/or a facial scan. This information can be used to insure that unauthorized copies of the key are not made. A sales person may review the security information prior to duplicating a key. In one embodiment, to preserve the owner's anonymity, a duplicate would only be made if a proper PIN number were provided by the customer, which matched the pin number stored on the data source.

Optionally when a key is duplicated, information relating to the master key and the customer is stored on the data key that is provided to the customer and is also stored on the duplication center's server (or on a secured server maintained for example, by a distributor of keys). Accordingly, if a company that has a national distribution network, such as, for example, Wal-Mart or the Home Depot, makes a copy of a customer's key and the customer loses the key while away from home and does not have her personal data key, the customer need only go to one of the company's retail stores provide the proper security information and have a copy of the key made from the information previously stored.

Figure 9:
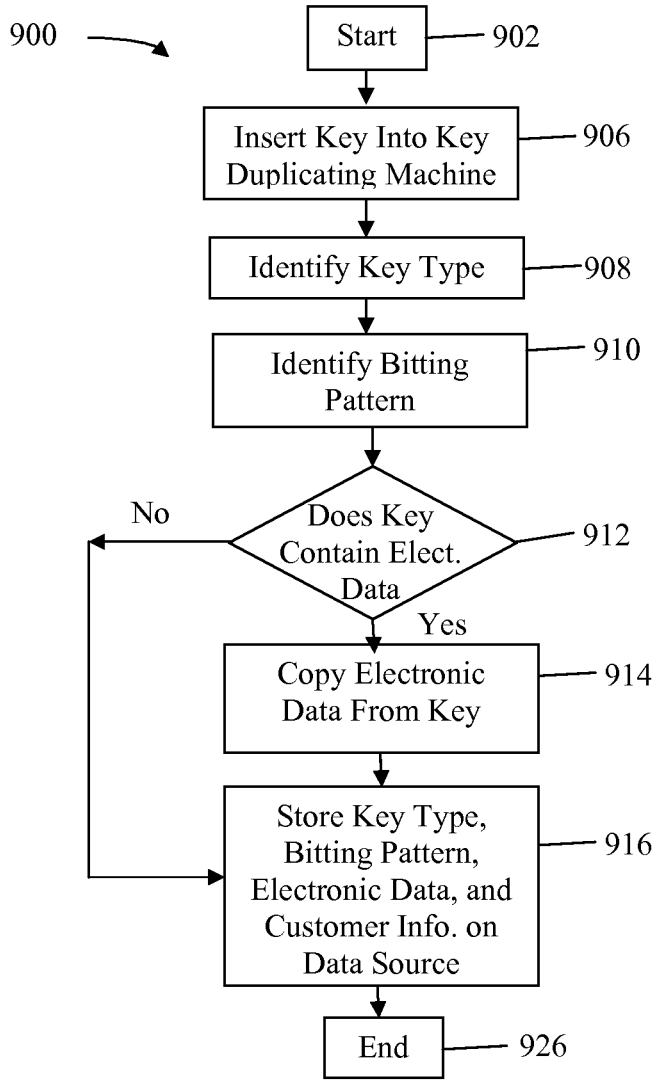
FIG. 9 is an additional exemplary block diagram of a method of creating a data key.

FIG. 9 illustrates a method of creating and saving a data key. The method begins at block 902. The customer's key is inserted into the key duplicating machine at block 906 and the type of key is identified at block 908. The bitting pattern is determined at block 910 and a determination is made at block 912 as to whether the customer's key contains electronic data. If it does not, the method proceeds to block 916. If the customer's key contains electronic data, the electronic data is copied from the key at block 914. At block 916, the key type, bitting pattern, electronic data if available and optionally the customer information are stored on and delivered to the customer in the form of a data key. The data key may be a physical device such as, for example, those described above or a jump drive that connects to a computer USB port. Optionally, the data key may be electronically transferred to a personal computing device, such as for example, a smart phone through a smart phone application (an "App") or a text message. It may be stored on a server and available to the customer through a downloadable file, email, or website link. Thus, the customer may obtain their data key and have it with them any time they have their personal computing device, such as a smart phone, a personal digital assistant ("PDA") or access to a computing device. Accordingly, if the customer loses their key, they need only upload the data key to a compatible key duplicating machine and have a duplicate key made. As described above, security steps may be taken to protect this information and ensure that only authorized persons have access to the information.

In addition, the electronic data key may be transmitted to a second person so that that person may have a key duplicated without the original customer having to travel to the location of the duplicating machine. For example, if a child is away at college in California and loses her keys to the car, her parents could simply travel to a key duplicating location in their hometown in Ohio with a second key, have the information stored as a data key and then transmit that information to their daughter who can go to a location in California that has a key duplicating machine, download the data key to that duplicating machine and have a key made from the data key.

It should also be clear from this disclosure that the present invention has numerous additional uses outside of the key industry. The present invention is equally applicable to other applications wherein the creation of a duplicate device is desired.

In addition, while the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, various combinations of the embodiments described herein may be combined with one another. Therefore, the invention in its broader aspects is not limited to the specific details, representative apparatus and methods, and illustrative examples shown and described. Accordingly, departures may be made from such details without departing from the spirit or scope of the applicant's general inventive concept.

We claim:

1. A data key comprising:

a computer readable medium including data indicative of a bitting pattern for a master key, wherein the bitting pattern is downloadable to a key cutting device to cut a duplicate key in a key blank to create the same bitting pattern as the master key;

security information stored on the computer readable medium configured to prevent unauthorized duplication of said master key wherein said security information includes at least one of an authorization code and a customer identification;

data information stored on the computer readable medium indicative of a key blank type to duplicate the master key; and wherein the data indicative of the bitting pattern, the security information, and the data information indicative of the key blank type are stored on a server such that the duplicate key may be made from the data without having the master key.

2. The data key of claim 1 wherein the data key is a personal data key sized to fit in a consumer's wallet or purse.

3. The data key of claim 1 wherein the data key is attachable to the key blank for shipping and detachable from the key blank when the bitting pattern is cut into the key blank.

4. The data key of claim 1 wherein the data key is transmitted to a personal computing device.

5. The data key of claim 1 further comprising information stored on the computer readable medium that is indicative of an electronic code copied from the master key.

6. The data key of claim 1 wherein the security information stored on the computer readable medium to prevent unauthorized duplication of the master key further comprises at least one of the following: a customer name, a personal identification number, biometric data, a fingerprint scan, photographic data, retinal scan, and a facial scan.

7. The data key of claim 1 wherein the data key includes instructions on at least one of (a) how to position the key and key blank in a holder; (b) instructions to obtain customer information; (c) instructions on promotional deals or discounts; (d) an origination address, (e) a destination address, (f) a manufacturer, (g) a manufacturing date, and (h) a lot number.

8. The data key of claim 1 wherein the computer readable medium comprises an RFID.

9. A method for duplicating keys, the method comprising:

creating a data key by obtaining security information from a first particular customer, wherein said security information includes at least one of an authorization code and a customer identification;

identifying a type of key blank for a master key;

determining a bitting pattern of the master key; and storing said security information, said type of key blank, and said bitting pattern on a storage device; and creating a duplicate key by obtaining proper security information from a second particular customer;

loading the data key into a key cutting machine;

inserting a proper key blank into said key cutting machine; and cutting said bitting pattern of the master key on said key blank to create said duplicate key.

10. The method of claim 9, wherein the storage device is a server.

11. The method of claim 9, wherein the storage device is a personal computing device.

12. The method of claim 9, wherein the security information further comprises at least one of the following: a customer name, a personal identification number, biometric data, a fingerprint scan, photographic data, retinal scan, and a facial scan.

13. The method of claim 9, wherein the first particular customer is the same person as the second particular customer.

14. The method of claim 9, wherein the creation of the data key includes the step of inserting the master key into a key duplication machine.

15. The method of claim 9, further comprising determining if the master key includes electronic and copying the electronic data in the data key.

16. The method of claim 15, further comprising loading the electronic data onto the proper key blank.

17. A key duplication system utilizing a data key comprising:

one or more key duplication machines configured to:

identify key information related to master keys including bitting pattern information, key blank information, and security information related to a user;

receive a request to store said key information determined by the key identification device; and verify the identity of the user;

store the key information to a computer readable medium; and one or more key cutting devices configured to:

receive a request from a user to retrieve said key information associated with the user;

verify the identity of the user;

receive the key information from a computer readable medium;

determine a key blank associated with the key information; and cut the key blank based on the key information.

* * * * *